US006350083B1

(12) United States Patent
Paladeni

(10) Patent No.: US 6,350,083 B1
(45) Date of Patent: Feb. 26, 2002

(54) POWERED ROLLER SCREED

(76) Inventor: Tod Paladeni, 1418 NW. 138th Cir., Vancouver, WA (US) 98685

( * ) Notice: Subject to any disclaimer, the term of this patent is extended or adjusted under 35 U.S.C. 154(b) by 0 days.

(21) Appl. No.: 09/304,616

(22) Filed: May 3, 1999

(51) Int. Cl.[7] ..... E01C 19/24

(52) U.S. Cl. ..... 404/118; 404/119; 404/103; 404/122; 404/131; 404/101

(58) Field of Search ..... 404/114, 117, 404/118, 119, 84.1, 84.2, 103, 122, 131, 101

(56) References Cited

U.S. PATENT DOCUMENTS

| | | | | | |
|---|---|---|---|---|---|
| 1,581,784 | A | * | 4/1926 | Butler | 404/103 |
| 1,886,367 | A | * | 11/1932 | Biles | 404/122 |
| 2,133,862 | A | * | 10/1938 | Kerns | 404/117 |
| 2,134,884 | A | * | 11/1938 | Moore, Jr. | 404/122 |
| 2,306,126 | A | * | 12/1942 | Jackson | 404/114 |
| 2,314,985 | A | * | 3/1943 | Jackson | 404/114 |
| 3,052,167 | A | * | 9/1962 | Beale | 404/122 |
| 3,415,174 | A | * | 12/1968 | Kaltenegger | 404/117 |
| 3,421,420 | A | * | 1/1969 | Piatkowski | 404/117 |
| 3,515,042 | A | * | 6/1970 | Austin | 404/117 |
| 3,547,014 | A | * | 12/1970 | Austin | 404/117 |
| 3,698,293 | A | * | 10/1972 | Wagner | 404/117 |
| 4,105,355 | A | * | 8/1978 | King et al. | 404/114 |
| 4,142,845 | A | | 3/1979 | Mitchell | |
| 4,614,486 | A | | 9/1986 | Bragagnini | |
| 5,016,319 | A | * | 5/1991 | Stigen | 404/119 |
| 5,456,549 | A | | 10/1995 | Paladeni | |
| 5,484,227 | A | * | 1/1996 | Ikeda et al. | 404/84.1 |
| 5,562,361 | A | | 10/1996 | Allen | |
| 5,664,908 | A | | 9/1997 | Paladeni | |
| 5,803,656 | A | | 9/1998 | Turck | |

FOREIGN PATENT DOCUMENTS

| | | | | |
|---|---|---|---|---|
| AU | 400782 | * | 9/1966 | 404/122 |

OTHER PUBLICATIONS

Roller Screed, advertisement brochure, date uncertain.

J.D. Concrete Screed, Self Propelled Concrete Roller Screeds, advertisement brochure, date uncertain.

"Bunyan Striker Tube" brochure, Bunyan Industries, Salt Lake City, Utah.*

"Roller Screed", Terramite Corporation, from www.terramite.com and "Roller Screed Questions & Answers", produced since 1977.*

* cited by examiner

*Primary Examiner*—Thomas B. Will
*Assistant Examiner*—Alexandra K. Pechhold
(74) *Attorney, Agent, or Firm*—ipsolon LLP

(57) ABSTRACT

A powered rotary screed provides a powered strike tube that rotates to provide a finish to wet concrete during screeding and a drive tube that provides motive power to the screed to assist with the difficult task of removing excess concrete from a poured pad, or other horizontal concrete surface. No framework or other supporting structure extends between ends of the screed thereby making the screed more portable than comparable screeds having a structure that supports the roller tubes and extends the length of the screed. Handles are pivotally coupled to plates at each end of the screed to maneuver and control the screed during operation. Because the handles are pivotally mounted, they can be pivoted outward to permit the screed to maneuver close to obstacles located near the pad. Additionally, the combination of the handles, strike tube, and drive tube permit the handles to be used as levers to control the effective motive power of the drive tube, thereby providing substantial control to the screed operators.

34 Claims, 3 Drawing Sheets

POWERED ROLLER SCREED

FIELD OF THE INVENTION

The present invention pertains to the field of roller screeds and more particularly pertains to powered roller screeds for screeding cementitious material.

BACKGROUND OF THE RELATED ART

Concrete structures are formed by pouring a cementitious material, such as cement and aggregate (referred to herein as concrete) into a form, or other container, and permitting the material to cure under proper conditions. In the case of a concrete pad, such as a floor, foundation, or roadway, concrete is poured onto a ground, or support, surface and contained by forms connected to, and rising above, the ground, or support, surface. The forms are longitudinal members arranged along a border of a desired location for the concrete pad to contain the viscous concrete and provide a guide for the concrete's thickness and to level the top surface of the concrete.

After concrete is poured between forms, it is spread evenly between the forms. A screed is then used to remove excess concrete and level the top surface of the concrete so it is even with the forms. Often, several passes of a screed over the concrete is necessary to achieve the desired surface. Precision is required to conform to building codes and to perform quality work.

A very primitive screed, which is still useful on small jobs, is a simple straight edge such as a straight board. A board, long enough to span the forms, is laid on top of each form and thereafter pulled down the length of the forms by workers at each end of the board. This pushes forward excess concrete: excess concrete is concrete that is higher than the top surface of the forms. While quite suitable for small jobs, such a screed is impractical on large jobs because of the work required to move the excess concrete.

A more practical screed for larger jobs is disclosed in Mitchell, U.S. Pat. No. 4,142,816. Mitchell discloses a powered screed having a hydraulic motor to spin a tubular member while the screed is pulled along the forms by two workers, one each located on either side of the forms. As with most rotary screeds, the tubular member spins in a direction opposite a direction of travel of the screed. By spinning the tube, this screed provides a good surface to the concrete. However, substantial work is required to pull the screed along the forms. The hydraulic motor, spinning the tube, does not assist to propel the screed forward and the heavy concrete that builds up in front of the screed requires a large amount of force to move. In addition, workers located at each end of the Mitchell screed must keep the screed tube substantially perpendicular to the forms—frequently this is a difficult task because of uneven amounts of concrete from side-to-side and unequal strengths of the workers.

Larger, powered screeds are suitable for large, high-volume jobs. U.S. Pat. No. 5,456,549 discloses a powered rotary screed having a modular frame that spans across concrete-retaining forms to supports a strike tube and drive tubes. The frame provides rigidity and support so that the screed can span large distances between forms. The strike tube rotates opposite the direction of screed travel to screed the concrete and the drive tubes provide motive force to propel the screed. While very useful for large jobs, and jobs that are not constrained by space limitations, these larger screeds are difficult to use in areas surrounded by obstacles and are more difficult to transport than the smaller screed described above. Also, in the event the screed becomes mis-aligned with the forms, the screed must be manually re-aligned, such as by holding back a leading end of the screed so that the trailing end can catch up.

Accordingly, there is a need in the industry to provide a powered screed that can be easily operated, even in areas that are constrained by nearby obstacles, and conveniently transported and set up for use.

SUMMARY OF THE INVENTION

The present invention provides a frameless roller screed having a drive tube to assist the screed operators to move the screed along forms over freshly poured concrete. The present invention has no form-spanning supporting structure or frame, thereby providing a lightweight, maneuverable, and easily transported screed. In addition, by providing handles, arranged as levers, in combination with a single drive tube and strike tube, the handles can be easily manipulated to control the effect of the drive tube for easy operation.

Preferably, hydraulic motors drive the strike tube and the drive tube. The strike tube is the leading edge of the screed as the screed is powered along the forms and by rotating the strike tube the advantages of a rotary screed are achieved—i.e., a better surface on the concrete. The drive tube is powered to provide mechanical assistance to push excess concrete forward as the screed moves along the forms. By providing motive power to the screed of the present invention, the screed operators can concentrate on achieving a high-quality finish on the concrete.

Preferably, the present invention screed is maneuvered by handles located on opposite ends of the screed and arranged as levers. The handles are pivotally mounted to frame elements so that the handles may be pivoted to provide greater screed maneuverability. For example, the handles may be pivoted outward allowing the screed to be driven up to obstacles such as a vertical wall at the end of a concrete pad.

Further, the handles are coupled to the screed such that an operator can push a distal end of the handle downward, or raise the distal end upward, to lever the drive tube about the strike tube. Accordingly, pushing down on the handle tends to lift the drive tube off of the forms so that forward motion of the screed may be easily, and quickly, halted. Alternatively, lifting the handles places more of the screed's weight on the drive tube and increases the drive tube's pressure on the forms so that the drive tube can provide more motive force without slipping.

The roller tubes of the present invention are coupled together by plates located on distal ends of the screed. The screed has no frame that extends substantially over the concrete, or spans the forms. Preferably, at least one of the plates includes an anti-skew box structure that prevents the tubes from skewing relative to one another and relative to the plates.

Accordingly, the present invention provides a frameless, powered roller screed having motive force to drive the screed along forms and assist in the difficult task of screeding heavy concrete. In addition, the present invention provides handles that can lever the drive tube to provide substantial control over the motive force generated by the drive tube. Also, the handles are provided with pivotal connections to connecting plates for greater screed maneuverability. And, by providing no frame elements that extend across the forms, the screed of the present invention is relatively easier to transport and setup as compared to prior art screeds having drive tubes.

DETAILED DESCRIPTION OF THE PREFERRED EMBODIMENTS

Figure 1:
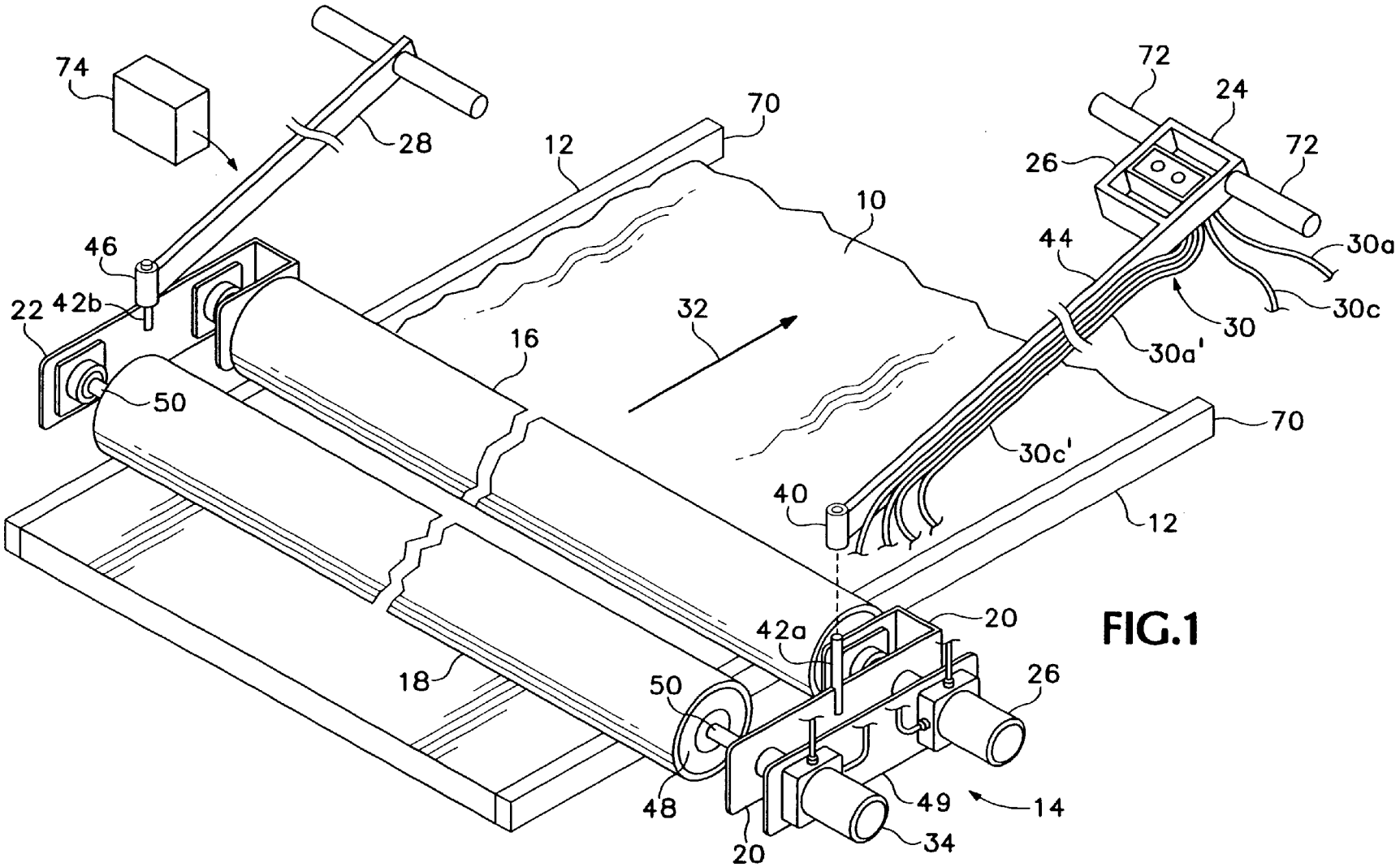
FIG. 1 is a perspective view of a preferred embodiment of a power driven roller screed of the present invention including an environment of screed forms supporting the roller screed and cementitious material located between the forms. The screed tubes are shown in broken view to represent indefinite lengths.

As stated, a conventional method of making a concrete pad is to pour concrete onto a surface and between concrete forms. With respect to FIG. 1, viscous concrete 10 is poured onto a floor, or ground surface, between two spaced-apart, longitudinal forms 12. The concrete is spread so that it covers the floor surface and contacts the forms 12. It is then necessary to screed a top, or exposed, surface of the concrete.

A preferred embodiment of a screed 14 of the present embodiment is shown located atop the forms 12 and includes a strike tube 16 and drive tube 18. The strike tube 16 and drive tube 18 are supported by plates comprising a drive element plate 20 and idler element plate 22. Attached to the drive element plate 20 is a control handle 24 having a control mechanism 26 mounted thereon. Attached to the idler element plate 22 is a second handle 28.

Hydraulic hoses, shown collectively at 30, provide hydraulic pressure from a hydraulic source (not shown) for powering the screed. In operation, hydraulic power is used to rotate the strike tube 16 and drive tube 18. The strike tube 16 is the leading-edge of the screed at the point of contact with the concrete as the screed proceeds along the forms 12. The drive tube 18 frictionally engages the forms and is hydraulically powered to move the screed along the forms and is the trailing edge of the screed. In the arrangement of FIG. 1, the screed will travel in the direction indicated by arrow 32.

In general, the control mechanism 26 is operated to control hydraulic power to the strike tube 16 and drive tube 18. Preferably, the rotation speed of the strike tube 16 will be fast relative to the rotation speed of the drive tube 18. In addition, the drive tube and strike tube will rotate in different directions. Thus, the strike tube will be driven to rotate such that a top of the strike tube is moving opposite the direction of travel and a top of the drive tube 16 is moving in the direction of travel 32. Accordingly, the strike tube 16 slips on the forms 12 as the screed proceeds along the forms.

The relatively high rotational speed of the strike tube, and its reverse rotation direction, provides a finish surface to the concrete 10. Additionally finishing of the surface may also be necessary.

As stated, the screed 14 includes the drive tube 18 and strike tube 16. In a preferred embodiment, each tube extends across the forms 12 and each is supported at one end by the idler element plate 22 and at another end by the drive element plate 20. Hydraulic motors 34 and 36 are coupled to the drive element plate and receive hydraulic power via the hydraulic hoses 30 to provide rotation to the strike tube and drive tube.

The strike tube and drive tube are rotatably mounted on the respective plates by thrust bearings 38*a*–38*f*. Each thrust bearing is fixedly coupled to one of the plates 22, 20.

The screed 14 of the present invention includes no supporting structure or framework to support the span of the screed across the forms 12. Accordingly, only the drive tube 18 and strike tube 16 span the forms 12. By providing a power driven screed have a minimal support structure, the screed of the present invention is more portable and maneuverable than a screed having a form-spanning framework.

Preferably, the control handle 24 is pivotally mounted to the screed 14. In the preferred embodiment, the control handle 24 includes a bushing 40 that is rotatably coupled to a pin 42*a* that is fixedly attached to the drive element plate 20. The control handle may be rotated outboard of the screed in order to make the screed more maneuverable in tight situations. For example, by rotating the control handle outboard 90 degrees from the orientation shown in FIG. 1 so that the longitudinal handle extension 44 is substantially aligned with the longitudinal direction of the strike tube 16, the strike tube can be driven very close to a vertical wall.

And, similarly, the second handle 28 includes a bushing 46 that is rotatably mounted on a pin 42*b* that is fixedly attached to the idler element plate 22 so that the second handle 28 may be rotated relative to the idler element plate so as to maneuver the screed.

In operation, an operator will grab the control handle 24 and operate the controls on the control mechanism 26. A second worker will grab the second handle 28. Subsequently an operator will turn the controls on the control mechanism 26 to provide hydraulic power to the hydraulic motors 34 and 36, which in turn will rotate the drive tube 18 and the strike tube 16, respectively.

Preferably, controls are provided to control the direction of rotation, and the speed of rotation, of each tube individually. As stated, preferably, the strike tube 16 is controlled so as to spin at relatively high rotational speed and opposed to the direction of travel. In contrast, the drive tube 18 is operated to propel, or drive, the screed 14 in the direction of travel 32 at a rate of speed approximately equal to a walking pace. Thus, an operator is located at each handle and the controls are operated to spin the strike tube and rotate the drive tube to move the screed so that freshly poured concrete in front of the screed 14 is screeded level with the forms 12. It may be desirable to make additional passes over the concrete to achieve the desired finish.

The screed may be further controlled during operation by raising and lowering the handles. When the operators raise the distal end of the handles, the screed pivots about the strike tube and more weight is placed on the drive tube thereby allowing the drive tube to obtain a better grip on the forms and provide more motive force to the screed. Alternatively, pushing down on the distal end of the handles pivots the screed about the strike tube and raises the drive tube off the forms thereby reducing the pressure of the drive tube on the form and the ability of the drive tube to push the screed forward. The operators can fine tune control of the screed by varying degrees of raising and lowering the distal ends of the handles.

This method of controlling the screed further permits the two operators to coordinate the screed motion. If one end of the screed lags behind the other end, one operator may raise or lower a particular end of the screed to increase or decrease its forward progress. Thus, each operator has significant control of the motive force of the operator's respective end independently of the hydraulic control device.

The Tubes

Preferably, the strike tube 16 and drive tube 18 are similar. Each tube is approximately six inches in diameter and fabricated of a structural metal such as steel or aluminum. Oftentimes it is desirable to have heavy tubes, making steel, or iron, a preferred material.

The ends of each tube are sealed by a round disc 48 that is fixedly attached, such as by welding, to the tubes so as to close off an interior of the tubes. The disc 48 further supports a tube axle 50 that extends axially outward from each end of each tube 16, 18.

Preferably, the tubes are connected to the plates 20, 22 by the thrust bearings 38*a*–38*f* that are bolted to the plates 20, 22. Where the tubes connect to a hydraulic motor, a shaft having a splined portion and a threaded portion (not shown) is provided wherein the splined portion passes through the bearing and plate and connects to a coupler, which in turn connects to the hydraulic motor. This method of connection is know in the art and taught in U.S. Pat. No. 5,456,549.

As shown, the motors are mounted on a motor plate 49 that is spaced-apart from the drive plate 22. This arrangement permits space to make connections between the axles, splined shafts, and the motors.

In order to prevent skewing, or misalignment, of the tubes relative to the plates 20, 22, and relative to each other, at least one plate, and preferably both plates, are provided with an anti-skew box member 60. With reference to the box member coupled to the drive plate 20, a preferred embodiment of the box member 60 includes a flange plate 62 arranged approximately 90 degrees to the plate 20. The box member 60 further includes a return plate 66 arranged substantially parallel to the plate 20 and approximately 90 degrees to the flange plate 62. A bottom plate 68 is connected to the drive plate 20, the flange plate 62, and the return plate 66 to provide additional rigidity to the box member structure. Additionally, further plates or cross-members may be provided for additional rigidity, such as across the opening from a distal end of the return plate 66 to the drive plate 20.

The anti-skew boxes 60 provide connection of the strike tube to the plates 20 at two spaced-apart locations that are rigidly connected. Accordingly, the relationship of the plates to the strike tube axle is substantially more secure than would be a single point connection between the plates and the strike tube axles. Accordingly, the anti-skew box maintains the drive plate 20 at an orientation substantially orthogonal to the strike tube axle 50 and assists in maintaining the parallel orientation of the drive tube and strike tube.

In alternative embodiments, an anti-skew box member 60 may be located on the strike tube only, the drive tube only, or a combination of the strike tube and the drive tube.

Drive Mechanism and Power Supply

Preferably, the present invention is coupled to a hydraulic power supply (not shown) via hydraulic hoses 30. In the present embodiment, the screed has hydraulic supply line 30*a* and a hydraulic return line 38*c*. The hydraulic supply line 30*a* is coupled to the control device 26 and connected to a manifold (not shown) wherein the supply line is divided into two supply lines 30*a*' that extend down the handle to the hydraulic motors 34 and 36. Hydraulic fluid returns to the control device through return lines 30*c*'.

The control device 26 is further provided with valve means to control, or regulate, the flow of hydraulic fluid to the respective hydraulic motors 34, 36 so that the control device can control the speed of rotation of each tube 16, 18 individually. By providing individual control, the control device is able to set a rotational speed and direction for the strike tube 16 and thereafter regulate the rotational speed and direction of the drive tube 18 so as to set a desired direction and speed for moving the screed along the forms 12 to screed the concrete 10.

Alternately, the control device may be arranged to switch the function of the strike tube and the drive tube so that the screed may be driven in a first direction and then driven in an opposite direction. For example, in the configuration as shown in FIG. 1, the screed device moves in the direction of motion 32 until the screed reaches an end of the forms 70, at which time the handles may be pivoted about respective pins 42*a*, 42*b* and the control device operated so that the leading tube becomes the strike tube and the trailing tube is the drive tube and the direction of travel is reversed.

Additionally, by providing additional controls to the control device 26 the direction of rotation of the strike tube 16 may be controlled so as to rotate in the same direction as the drive tube 18, but a higher rate of rotation, on a final pass over the concrete so as to provide a skim coat.

Preferably, the drive tubes include a non-slip surface, such as a wear-resistant, elastomeric material that has a relatively high coefficient of friction with the forms. A suitable material is a high wear synthetic rubber, such as is used on road tires.

In yet another configuration, four hydraulic hoses 30 may be provided from two hydraulic power supplies to the control device 26 wherein two hoses are hydraulic supply lines and two hoses are hydraulic return lines. This four-hose embodiment may provide less complicated connections and fittings at the control device.

Additional Alternative Embodiments

Figure 2:
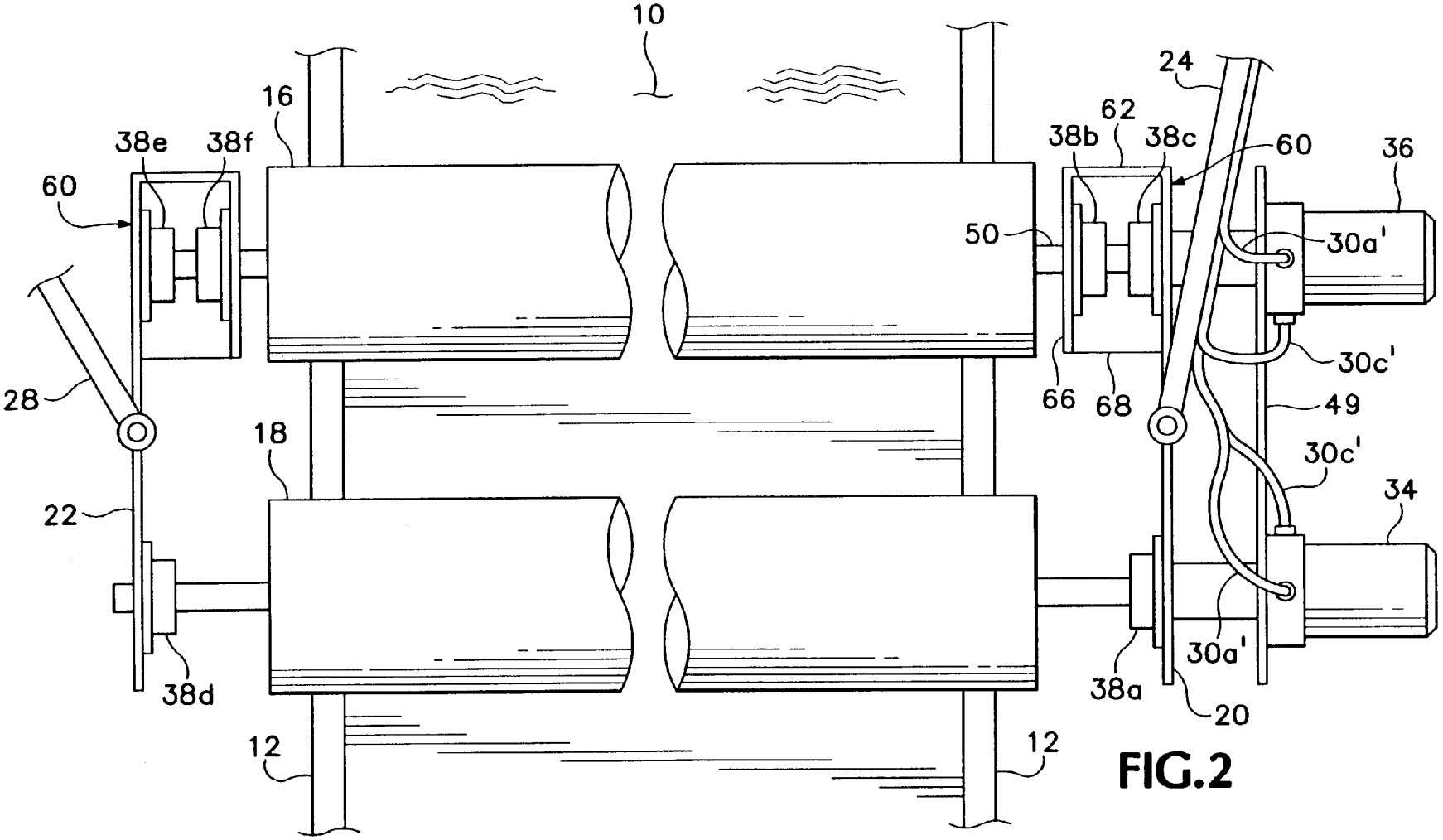
FIG. 2 is a top plan view of a preferred embodiment of the roller screed of the present invention wherein the screed tubes are shown in broken view to represent indefinite lengths.
Figure 3:
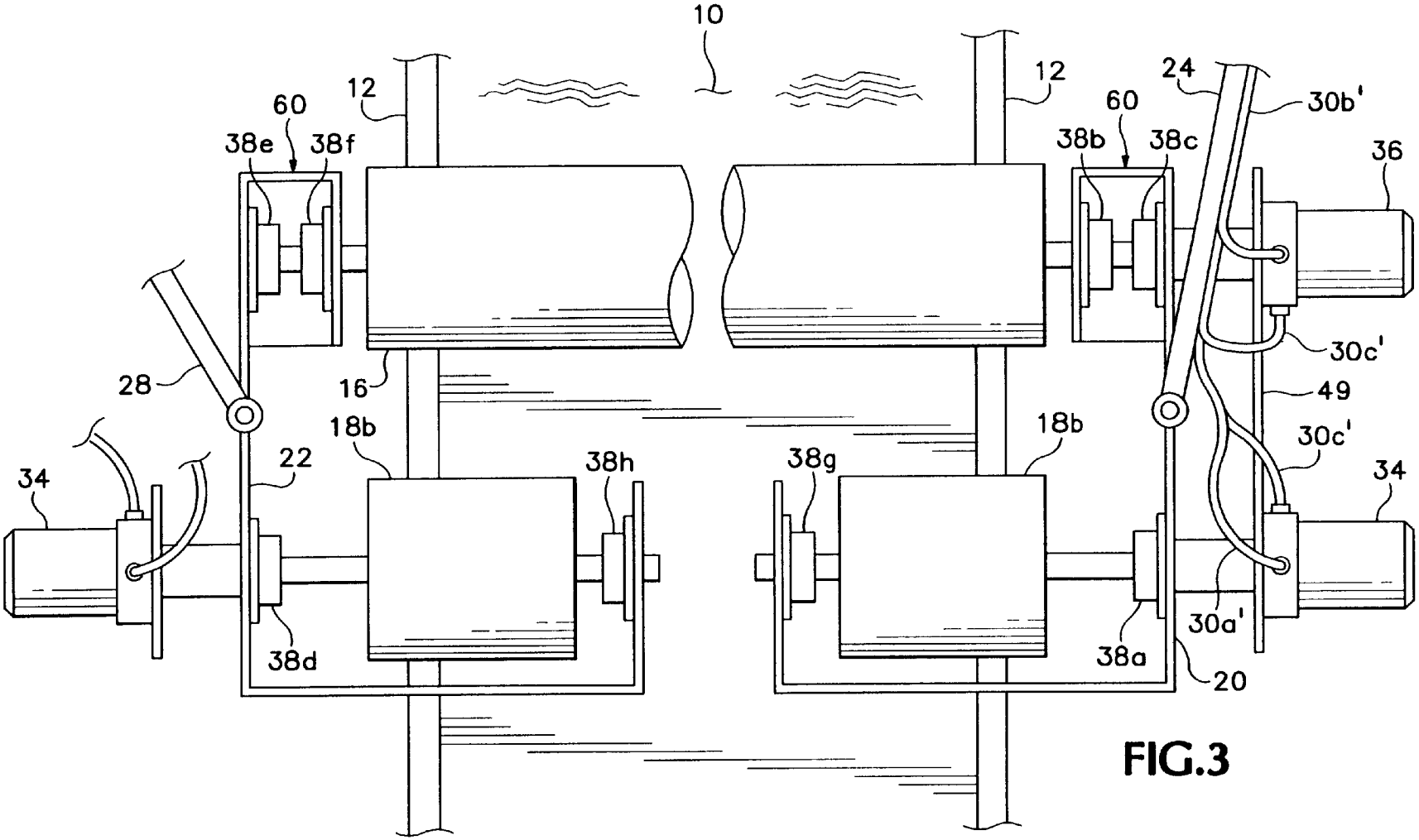
FIG. 3 is a top plan view of an alternative embodiment of the roller screed of the present invention wherein the screed tubes are shown in broken view to represent indefinite lengths.

In the embodiment of FIGS. 1 and 2, the drive tube 18 is shown configured substantially similar to the strike tube 16. Alternatively, the drive tube may be configured in a split arrangement as shown in FIG. 3. In a split-arrangement drive tube, separate drive tube portions 18*a* and 18*b* are separately supported by frame element extensions 20*a* and 22*a*. The drive tube portions have a length sufficient to extend away from the frame elements 20, 22 and rest on the respective forms 12. In the configuration shown, both drive tube portions 18*a* and 18*b* are powered. Drive tube portion 18*a* is powered by hydraulic motor 34 as in the embodiments described above. Drive tube portion 18*b* is powered by an additional hydraulic motor 35. Drive portion 18*a* is provided to properly balance the screed on the forms and prevent an unstable structure.

In the embodiments of FIGS. 1–3, the hydraulic motors are shown mounted outboard of the frame element 20. Alternatively, the hydraulic motors 34 and 36 may be mounted above ends the tubes 16, 18 and provide motive power to the tubes by gear, belt, or chain connection to sprockets mounted on the tube axles 50.

In FIG. 1 the control mechanism 26 is generically represented as including two control knobs. Alternatively, the control mechanism 26 may take many different forms, such as including dead man switches coupled to the handle extensions 72 that protrude outboard from the control handle 24.

In yet another embodiment, the screed may be operated by one person. In this embodiment, the second handle is oriented 180° from the direction of screed motion, that is, the second handle is oriented so that it is pointing backward and extends over the drive tube. A weight 74 is attached to the second handle thus urging the handle downward toward the screed so that the drive tube applies more pressure to the form. Preferably, the weight is approximately 40 lbs. (88 Kg.) and is located approximately 10 to 12 inches (25 to 50 cm) away from the idler plate along the handle.

The screed is then operated by a single operator who controls the screed from the control handle 24. By setting the hydraulic power controls at the control device the screed is set in motion. Thereafter, the operator can easily control the screed by raising and lowering (i.e., moving away from or toward the form) the handle so as to control the amount of motive force the drive tube imparts to the screed.

SUMMARY

This patent specification sets forth a detailed description of a preferred embodiment of the invention as known to the inventors at the time the underlying patent application was filed. Also disclosed are such alternative embodiments, known at the time of filing, that readily occur to the inventors. No attempt is made to describe all possible embodiments, modes of operation, designs, steps or means for making and using the invention. To include all such information would unduly confuse the description of the preferred embodiments and would not serve to provide further information to persons skilled in the art of this invention.

Where necessary, the specification describes the invention and states certain arrangements of parts, materials, shapes, steps, and means for making and using the invention. However, the invention may be made and used with alternative arrangements, materials, and sizes. Thus, it is intended that the scope of the invention shall only be limited by the language of the claims and the law of the land as pertains to valid patents.

What is claimed is:

1. A frameless roller screed, comprising:

a) a first tube having a length terminating in a first end and a second end;

b) a second tube having a length terminating in a first end and a second end;

c) a first plate element rotatably coupled to the first ends of the first and second tubes so that the first and second tubes can rotate independently of each other;

d) a second plate element rotatably coupled to the second ends of the first and second tubes so that the first and second tubes can rotate independently of each other;

e) a first driver coupled to the first tube that can rotate the first tube;

f) a second driver coupled to the second tube that can rotate the second tube;

g) having no frame and no structure extending from the first end to the second end of the first and second tube; and, h) a handle having an elongate lever portion and a handle portion, the lever portion operably secured to one of said first or second plates at a contact point between said first and second tubes such that raising or lowering the handle portion causes the screed to pivot about said first tube and thereby regulates the amount of motive force provided by said second tube.

2. The frameless roller screed of claim 1, wherein said first tube rotates in a direction so as to drive said frameless roller screed in a direction of motion, and said first and second tubes counter-rotate with respect to each other.

3. The frameless roller screed of claim 2, wherein said second tube rotates faster than said first tube.

4. The frameless roller screed of claim 1, wherein said handle further includes:

a neutral position wherein an amount of pressure applied by the first tube to a structure that supports the screed is substantially equal to an amount of pressure applied by the second tube to a surface being screeded;

a first position wherein an amount of pressure applied by the first tube to the structure that supports the screed is greater than an amount of pressure applied by the second tube to the surface being screeded; and a second position wherein an amount of pressure applied by the first tube to the structure that supports the screed is less than an amount of pressure applied by the second tube to the surface being screeded.

5. The frameless roller screed of claim 4, wherein said first position involves tilting said handle upward from said neutral position, and said second position involves tilting said handle downward from said neutral position.

6. The roller screed of claim 1 further comprising a control device that controls the first and second driver and thereby controls a rate of rotation of the first tube and the second tube, respectively.

7. The roller screed of claim 1 wherein the first and second driver are hydraulic motors coupled to the first and second tubes, respectively.

8. The roller screed of claim 1 further comprising an anti-skew member fixedly coupled to the first plate element.

9. The roller screed of claim 1 wherein the first plate element includes a box member that prevents skewing of the first plate element relative to the first tube.

10. The roller screed of claim 1 wherein the first plate element and the second plate element include a box member that receives an axle of the first tube and couples to the axle at two, spaced-apart locations to maintain a desired orientation of the first tube and the second tube.

11. The roller screed of claim 1 wherein said handle is pivotally coupled to the first plate element such that said handle may be rotated relative to the screed so that the screed may be operated closer to environmental obstacles.

12. The roller screed of claim 1 wherein said handle is a first handle pivotally coupled to the first plate element and further including a second handle pivotally coupled to the second plate element such that said first and second handles may be rotated so as to move the screed closer to obstacles without interference by the handles.

13. The roller screed of claim 1 wherein said second tube has a first drive tube portion located proximate the first end of the screed and a second drive tube portion located proximate the second end of the screed and the second tube is discontinuous between the first drive tube portion and the second drive tube portion.

14. A roller screed, comprising:

a) a first elongate roller tube powered by a power source to rotate about a first axis in a first direction of motion of the roller screed during screeding;

b) a second elongate roller tube powered by a power source to rotate about a second axis, said first and second axes are spaced apart and substantially parallel to each other, said first and second elongate roller tubes are supported on a form and operably secured to a frame extending between said first and second elongate roller tubes; and c) an elongate first handle having first and second ends, said first end operably secured to said frame at a first attachment point, said attachment point spaced apart from said second axis by a discrete distance along the first direction of motion of the roller screed such that the discrete distance defines a first moment arm for the handle to serve as a lever for pivoting the screed about said second roller tube, and said attachment point spaced is apart from said first axis by a second discrete distance along the first direction of motion of the roller screed such that the second discrete distance defines a second moment arm for the handle to serve as a lever for pivoting the screed about said first roller tube, said elongate first handle extending from said first attachment point, over at least one of said first and second axes such that said at least one of said first and second axes is substantially transverse to said elongate handle and between said first and second ends;

d) wherein the second end of said first elongate handle can be urged toward or away from the form to pivot the screed about one of said first and second elongate roller tubes and thereby cause the first roller tube to apply less or more pressure on the form to control the operation of the screed.

15. The roller screed of claim 14, wherein said roller screed can operate in said first direction and an opposite second direction, in the first direction the first elongate roller tube rotates so as to drive the roller screed and the second elongate roller tube counter-rotates with respect to the rotation of said first elongate roller tube; and, in the second direction, the second elongate roller tube rotates so as to drive the roller screed, and the first elongate roller tube counter-rotates with respect to the rotation of said second elongate roller tube.

16. The roller screed of claim 15, wherein said first attachment point is between said first and second elongate roller tubes.

17. The roller screed of claim 16, wherein said first handle lever includes:

a neutral position wherein the amount of pressure applied by the first roller tube to the form is substantially equal to the amount of pressure applied by the second roller tube to the form;

a first position wherein the amount of pressure applied by the first roller tube to the form is greater than the amount of pressure applied by the second roller tube to the form; and, a second position wherein the amount of pressure applied by the first roller tube to the form is less than the amount of pressure applied by the second roller tube to the form.

18. The roller screed of claim 15, wherein said second elongate roller tube rotates faster than said first elongate roller tube when the roller screed is traveling in said first direction; and said first elongate roller tube rotates faster than said second elongate roller tube when the roller screed is traveling in said second direction.

19. The roller screed of claim 14 further comprising an elongate second handle having first and second ends, said first end of said second handle operably secured to said frame at a second attachment point, said second attachment point spaced apart from said second axis along the first direction of motion of the roller screed, said elongate second handle extending from said second attachment point, over said second axis such that said at said second axes is substantially transverse to said elongate handle and between said first and second ends of said elongate second handle, and wherein the second end of said second handle can be urged toward or away from the form to cause the first roller tube to apply less or more pressure on the form to control the operation of the screed.

20. The roller screed of claim 19 wherein the first elongate roller tube provides motive force to the screed to move the screed along the form and wherein urging the second end of said first or second elongate handles toward or away from the form causes the first roller tube to apply less or more pressure on the form to thereby regulate the motive force to the screed.

21. The roller screed of claim 20 wherein said screed has a left side and a right side, and said first elongate handle is secured to said left side and said second elongate handle is secured to said right side; and, the first elongate handle may be operated independently of the second elongate handle to thereby control the left side of the screed separately from the right side of the screed.

22. The roller screed of claim 14 wherein the first elongate handle is pivotally coupled to the screed so that the first elongate handle can pivot relative to the screed.

23. The roller screed of claim 14, wherein said second elongate roller tube rotates faster than said first elongate roller tube.

24. A roller screed, comprising;

a first elongate roller tube powered by a power source to rotate about a first axis in a first direction of motion of the roller screed during screeding;

a second elongate roller tube powered by a power source to rotate about a second axis, said first and second axes are spaced apart and substantially parallel to each other, said first and second elongate roller tubes are supported on a form and operably secured to a frame extending between said first and second elongate roller tubes; and a substantially elongate first handle having first and second ends, said first end operably secured to said frame at a first attachment point, said attachment point spaced apart from said second axis along the first direction of motion of the roller screed, said elongate first handle extending from said first attachment point such that said second axis is positioned substantially transverse to said elongate first handle and between said first and second ends of said elongate first handle;

wherein said second end can be urged toward or away from the form to pivot the screed about said second elongate roller tube and thereby cause the first roller tube to apply less or more pressure on the form to control operation of the screed.

25. The roller screed of claim 24 further comprising an elongate second handle having first and second ends, said first end of said second handle operably secured to said frame at a second attachment point, said second attachment point spaced apart from said second axis along the first direction of motion of the roller screed, said elongate second handle extending from said second attachment point such that said second axis is positioned substantially transverse said elongate second handle and between the first and second ends of said second handle; and, wherein said second end of said second handle can be urged toward or away from the form to pivot the screed about said second elongate roller tube and thereby cause the first roller tube to apply less or more pressure on the form to control operation of the screed.

26. The roller screed of claim 25 wherein the first elongate roller tube provides motive force to the screed to move the screed along the form and wherein urging the second end of the first or second elongate handles toward or away from the form causes the first roller tube to apply less or more pressure on the form to thereby regulate the motive force to the screed.

27. The roller screed of claim 25 wherein said screed has a left side and a right side, and said first elongate handle is secured to said left side and said second elongate handle is secured to said right side; and, the first elongate handle may be operated independently of the second elongate handle to thereby control the left side of the screed separately from the right side of the screed.

28. The roller screed of claim 24, wherein said roller screed can operate in said first direction and an opposite second direction, in the first direction the first elongate roller tube rotates so as to drive the roller screed and the second elongate roller tube counter-rotates with respect to the rotation of said first elongate roller tube; and, in the second direction, the second elongate roller tube rotates so as to drive the roller screed, and the first elongate roller tube counter-rotates with respect to the rotation of said second elongate roller tube.

29. The roller screed of claim 28, wherein said second elongate roller tube rotates faster than said first elongate roller tube when the roller screed is traveling in said first direction; and said first elongate roller tube rotates faster than said second elongate roller tube when the roller screed is traveling in said second direction.

30. The roller screed of claim 24, wherein said first attachment point is between said first and second elongate roller tubes.

31. The roller screed of claim 30, wherein said first handle lever includes;

a neutral position wherein an amount of pressure applied by the first roller tube to the form is substantially equal to an amount of pressure applied by the second roller tube to the form;

a first position wherein an amount of pressure applied by the first roller tube to the form is greater than an amount of pressure applied by the second roller tube to the form; and, a second position wherein an amount of pressure applied by the first roller tube to the form is less than an amount of pressure applied by the second roller tube to the form.

32. The roller screed of claim 24 wherein the first elongate handle is pivotally coupled to the screed so that the first elongate handle can pivot relative to the screed.

33. The roller screed of claim 24, wherein said second elongate roller tube rotates faster than said first elongate roller tube.

34. The roller screed of claim 24, wherein said second axis and said elongate first handle do not intersect.

* * * * *